US007325427B2

(12) United States Patent
Ingvarsson

(10) Patent No.: US 7,325,427 B2
(45) Date of Patent: Feb. 5, 2008

(54) MACHINE FOR BENDING OF LONG PRODUCTS AND A METHOD TO CONTROL SUCH A MACHINE

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 43 days.

(21) Appl. No.: 10/563,776

(22) PCT Filed: Jul. 1, 2004

(86) PCT No.: PCT/SE2004/001063

§ 371 (c)(1),
(2), (4) Date: Jan. 6, 2006

(87) PCT Pub. No.: WO2005/005071

PCT Pub. Date: Jan. 20, 2005

(65) Prior Publication Data

US 2006/0175311 A1 Aug. 10, 2006

(30) Foreign Application Priority Data

Jul. 10, 2003 (SE) ..... 0302082

(51) Int. Cl.
*B21D 5/14* (2006.01)

(52) U.S. Cl. ..... 72/7.4; 72/173

(58) Field of Classification Search ..... 72/7.4, 72/11.1, 37, 167, 173
See application file for complete search history.

(56) References Cited

U.S. PATENT DOCUMENTS

| | | | | |
|---|---|---|---|---|
| 3,339,392 | A * | 9/1967 | Buckwalter et al. | 72/166 |
| 4,761,979 | A | 8/1988 | Kawaguchi et al. | |
| 5,187,959 | A * | 2/1993 | Davi | 72/10.6 |
| 7,032,420 | B2 * | 4/2006 | Bourgon et al. | 72/11.7 |
| 7,185,519 | B2 * | 3/2007 | Clark | 72/9.1 |

FOREIGN PATENT DOCUMENTS

| | | |
|---|---|---|
| EP | 0477752 | 4/1992 |
| WO | 0203026 | 1/2002 |

* cited by examiner

*Primary Examiner*—Daniel C Crane
(74) *Attorney, Agent, or Firm*—Mark P. Stone

(57) ABSTRACT

A machine is process monitored and controlled for continuous bending of long products to a predetermined radius by using three parallel contact-free distance meters (laser transmitters) and by measuring the distances to the bent surface on the product, by calculating the actual bending radius based on the fixed distances between the meters and the measured distances, and controlling the adjustment of the machine in response to the relation between the calculated actual radius and the desired radius. The machine comprises a processor for performing said calculation and controlling the bending device.

3 Claims, 1 Drawing Sheet

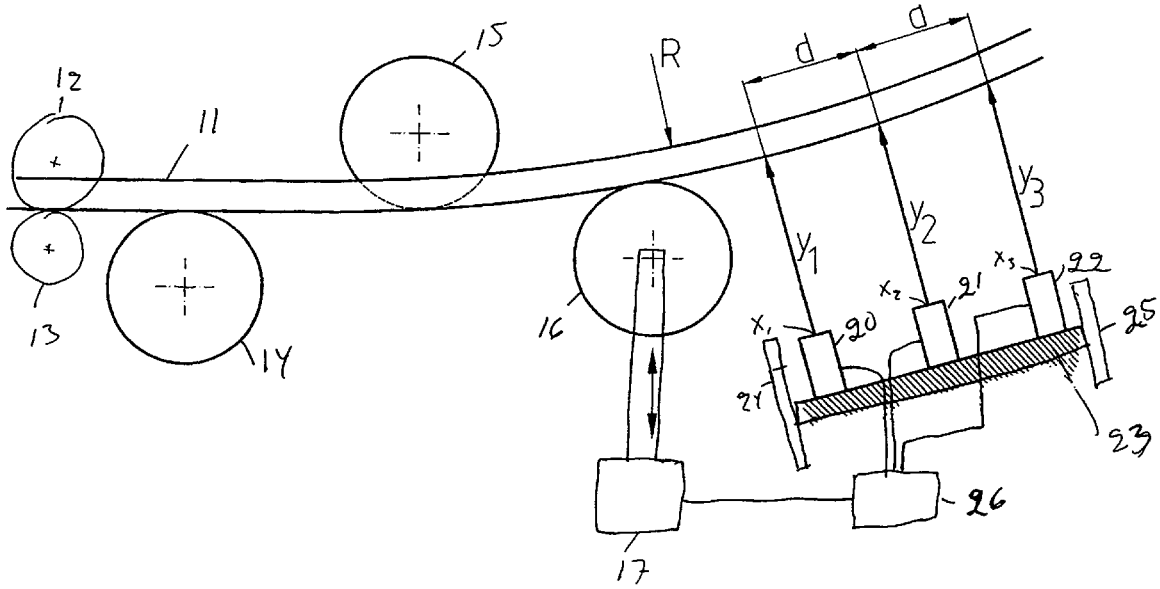
12
11
15
R
d
a
13
14
16
$y_1$
$y_2$
$y_3$
$x_1$
$x_2$
$x_3$
20
21
22
25
23
26
17

MACHINE FOR BENDING OF LONG PRODUCTS AND A METHOD TO CONTROL SUCH A MACHINE

FIELD OF THE INVENTION

The present invention relates to a method to process monitor and control a machine for continuous bending of long products to a predetermined radius. The invention also relates to a machine for continuous bending of long products to a predetermined radius, comprising a bending device and a feeding device for feeding the long product through the bending device.

BACKGROUND OF THE INVENTION

When continuously bending a long product of metal, a spring back occurs that entails that the bending radius will not be the desired one unless allowance for the spring back has been made upon adjustment of the machine. The spring back is different for different metals and steel grades and may also vary within, for instance, one steel grade, which may entail poor accuracy.

OBJECT OF THE INVENTION

It is an object of the invention to be able to bend a long product with high accuracy of the bending radius.

BRIEF DESCRIPTION OF THE DRAWING

FIG. 1 shows schematically and fragmentary, as an embodiment example of the invention, a top plan view of a machine during continuous bending of a long product.

DESCRIPTION OF SHOWN EXAMPLE OF THE INVENTION

FIG. 1 shows a long product 11, which may be a steel product, during continuous bending in a bending machine. The long product is shown as a U-girder or as a steel plate having bent-up sides. The bending machine is shown utmost fragmentary and schematically. It has a feeding device in the form of two motor-driven rolls 12, 13 that feed the long product through the machine. The machine has a first fixed roll 14, which abuts against one of the sides of the long product, and a roll 15, which is adjustable and abuts against the other side of the long product. A third roll 16 is displaceable by means of a power means 17 to and from the long product, as is shown by the arrow, for bending the product to the desired radius when the product is fed through the three rolls 14, 15, 16.

Three contact-free distance meters arranged in parallel in the form of laser transmitters 20,21 22 are fastened on a common frame 23. The frame 23 is mounted in guide rails 24,25 so that it is displaceable to and from the long product 11. The laser transmitters measure the distance to three distinct points along a bent surface on the long product. The laser transmitters are coupled to a processor 26 and the processor 26 is coupled to control the power means 17.

The distance between the parallel measuring beams of the laser transmitters 20,21 and between parallel measuring beams of the laser transmitters 21,22 is equal and has been designated "d" in the FIGURE. The distances measured by the laser transmitters 20,21,22 have been designated "$y_1$", "$y_2$", "$y_3$".

The processor 26 calculates actual bending radius based on the fixed distances between the measuring beams and the three measured distances "y" and compares the calculated actual bending radius (the actual value) with the desired radius (the set value) and controls the power means 17 to lift the roll 16 to a position which gives an actual calculated bending radius corresponding to the desired one.

The radius may be calculated according to the known general formula $1/R=y''/(1+(y'))^{3/2}$.

For the small distances between the measuring beams, the equation $x^2+y^2=R^2$ of the circle may be replaced by a second-degree polynomial $y=f(x)$, i.e. $y=a+bx+cx^2$ and three equations are obtained with three unknowns. Said second-degree polynomial may relatively easy be derived and gives $y'=b+2cx$ and $y''=2c$. It is suitable to choose a orthogonal coordinate system with the y-axis parallel to the laser beams and the origin in the beginning of the measuring beam $y_1$ so that $x_1=a$, $x_2=d$, $x_3=2d$, where the x-values accordingly are the values of the three laser beams along the abscissa.

The following system of equations is then obtained $$y_1=a$$

$$y_2=a+bd+cd^2$$

$$y_3=a+b(2d)+c(2d)^2$$

The above-mentioned general formula for the radius of the circle gives $$R=(1+(y')^2)^{3/2}/Y'' \text{ which becomes } R=(1+(b+2cd)^2)^{3/2}/2c$$

Thus, the actual circle radius may easy be calculated by an approximation, which gives an error of only some percent, since the distance between the three laser beams is relatively small. The distance may suitably be about 200 mm between two laser beams.

Laser transmitters for measurement of distance have a relatively small measuring range but since it solely is the relation between the measured values y that is of interest, the frame 23 on which the meters are mounted may be moved along the guide rails 24,25 thereof without influencing the calculation.

Roofing sheet having standing seam, where the raised longitudinal edges of the sheet-metal plates are terminated by beads that are snapped together, are normally only used as straight sheetmetal plates. SE 0103229-1 and PCT/SE02/01689 (corresponding to U.S. Ser. No. 10/806,865 filed Mar. 23, 2004 and published as U.S. 2004-0173002A1 on Sep. 9, 2004) provide, however, a method and a machine for bending such sheet-metal plates. The raised edges are rolled thinner against the beads in order to get a bending that is adapted for a convex roof, for instance a domed roof, or the raised edges are instead rolled thinner against the bottom when a bending adapted for a concave roof is desired. In this application for roofing sheet, the actual bending adapted for a concave roof is desired, in this application for roof sheet, the actual bending radius may vary fairly much from the one desired by virtue of stresses in the rollshaped sheet metal. Therefore, the present invention has a particular bearing on that product. The invention is directly applicable on the machine that is shown in these patent applications, but it is also possible to supplement the machine shown in the references with the bending rolls 15 and 16 shown in the present application. These rolls are then arranged after the rolling rolls and provide a last bending for final adjustment of the bending radius. It is possible to control both the rolling rolls and the roll 15 in response to the calculated actual bending radius or only control the roll 15 in this way. The bending device will in this case comprise both the rolling rolls according to the above-cited publications and the bending rolls 15 and 16. The machine according to the above-mentioned publications is not described but reference is made to the aforementioned published U.S. patent application.

The inventioned claimed is:

1. Method to process monitor and control a machine for continuous bending of long products (11) to a predetermined radius, comprising, bending the long product into a radius and using three parallel, fixed contact-free distance meters (20-22) and measuring the distances to the bent surface on the product (11), the actual bending radius is calculated based on the fixed distances between the meters and the measured distances, and adjustment of the machine is carried out in response to the calculated actual radius in relation to the desired radius, and in that for the calculation, the bending radius between the measuring points is approximated by means of a second-degree polynomial.

2. Method according to claim 1, characterized in that laser transmitters (20-22) are used.

3. Machine for continuous bending of long products to a predetermined radius, comprising a bending device for bending the long product with a radius and a feeding device for feeding the long product through the bending device, characterized by three parallel contact-free distance meters for measurement of the distances to the bend surface of the long product, a processor coupled to the distance meters for calculation of the actual bending radius and coupled to control the adjustment of the machine in response to the relation between the calculated actual bending radius and the desired radius, wherein, for the calculation, the bending radius between the measuring points is approximated by means of a second-degree polynomial.

* * * * *